US008475122B1

(12) United States Patent
Liang

(10) Patent No.: US 8,475,122 B1
(45) Date of Patent: Jul. 2, 2013

(54) BLADE OUTER AIR SEAL WITH CIRCUMFERENTIAL COOLED TEETH

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 665 days.

(21) Appl. No.: 13/007,770

(22) Filed: Jan. 17, 2011

(51) Int. Cl.
*F01D 11/08* (2006.01)

(52) U.S. Cl.
USPC ..... 415/173.1; 415/115; 415/116; 415/173.4; 415/176; 415/178

(58) Field of Classification Search
USPC ..... 415/173.1, 115, 116, 173.4, 176, 415/178, 200
See application file for complete search history.

(56) References Cited

U.S. PATENT DOCUMENTS

| | | | | |
|---|---|---|---|---|
| 5,282,721 | A * | 2/1994 | Kildea | 416/97 R |
| 6,508,623 | B1 * | 1/2003 | Shiozaki et al. | 415/173.1 |
| 2004/0047725 | A1 * | 3/2004 | Tomita et al. | 415/116 |
| 2005/0129499 | A1 * | 6/2005 | Morris et al. | 415/1 |
| 2006/0216143 | A1 * | 9/2006 | Trinks et al. | 415/173.1 |
| 2006/0216146 | A1 * | 9/2006 | Thompson et al. | 415/213.1 |
| 2010/0232929 | A1 * | 9/2010 | Joe et al. | 415/1 |
| 2011/0171011 | A1 * | 7/2011 | Lutjen et al. | 415/173.5 |

* cited by examiner

*Primary Examiner* — Fenn Mathew
*Assistant Examiner* — Eldon Brockman
(74) *Attorney, Agent, or Firm* — John Ryznic

(57) ABSTRACT

A BOAS with a blade tip shroud having a row of teeth formed by rows of grooves on an underside surface, and where rows of teeth include cooling air passages to provide cooling for the blade tip shroud and to discharge cooling air into the blade tip gap to reduce an effective hot gas leakage area to reduce the blade tip leakage flow. The cooling passages include inlet convergent channels to increase the cooling air flow velocity, followed by flow metering sections and then cooling air exit slots that open onto the bottom surface of the teeth.

6 Claims, 5 Drawing Sheets

BLADE OUTER AIR SEAL WITH CIRCUMFERENTIAL COOLED TEETH

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to an air cooled blade outer air seal (BOAS) with teeth for an industrial gas turbine engine.

2. Description of the Related Art including Information Disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A row or stage of turbine rotor blades rotate within an annular arrangement of ring segments in which blade tips form a small gap with an inner or hot surface of each ring segment. The size of the gap changes due to different thermal properties of the blade and the BOAS or ring segments from a cold sate to a hot state of the turbine. The smaller the gap, the less hot gas leakage will flow between the blade tips and the ring segments.

An IGT engine operates for long periods of time at steady state conditions, as opposed to an aero gas turbine engine that operates for only a few hours before shutting down. Thus, the parts in the IGT engine must be designed for normal operation for these long periods, such as up to 40,000 hours of operation at steady state conditions.

High temperature turbine blade tip shroud heat load is a function of the blade tip section leakage flow. A high leakage flow will induce a high heat load on the blade tip shroud. Therefore, blade tip shroud cooling and sealing issues must be considered as a single problem.

FIGS. 1 through 3 show a prior art blade tip shroud design with a grooved turbine blade tip shroud 31 that includes multiple grooves 32 at angles of 90 to 130 degrees relative to the shroud backing structure, and where the grooves 32 extend into the hot gas flow path fro an entire axial length of the blade outer air seal. The tip shroud 31 is secured to a blade ring carrier 11 through a second piece 13 and forms a cooling air supply cavity 12. An impingement plate 21 with impingement holes 22 directs impingement cooling air onto the backside surface of the tip shroud to produce impingement cooling. As seen in FIG. 2, the tip shroud grooves 32 extend from one end to the opposite end in a straight line with the arrows representing the tip leakage flow direction. FIG. 1 shows the hot gas flow along an outer endwall of an adjacent stator vane assembly 15 and the leakage flow in the blade tip region and in the gap formed between the blade tip and the blade tip shroud 31. FIG. 3 shows the grooves 32 forming teeth 34 with the leakage flow recirculation within the grooves 32 and the leakage flow through the gap.

The main purpose of using a grooved tip shroud in a blade design is to reduce the blade tip leakage and to provide for rubbing capability of the blade tips. The grooved blade tip shroud 31 in FIG. 1 is not cooled. Since the turbine inlet temperature has been steadily increasing over the past few years, cooling of the grooved blade tip shroud becomes necessary.

BRIEF SUMMARY OF THE INVENTION

The grooved blade outer air seal (BOAS) leakage flow and cooling issues described above in the prior art can be alleviated by the sealing and cooling design for the turbine blade tip shroud of the prior art by including metering and diffusion cooling passages formed within the teeth of the grooved tip shroud that discharge cooling air into the leakage flow gap to reduce a resulting vena contractor and create a decrease leakage flow area for the hot gas flow. The spent cooling air from backside impingement cooling of the tip shroud is used to pass through the tip shroud teeth cooling air passages.

DETAILED DESCRIPTION OF THE INVENTION

Figure 1:
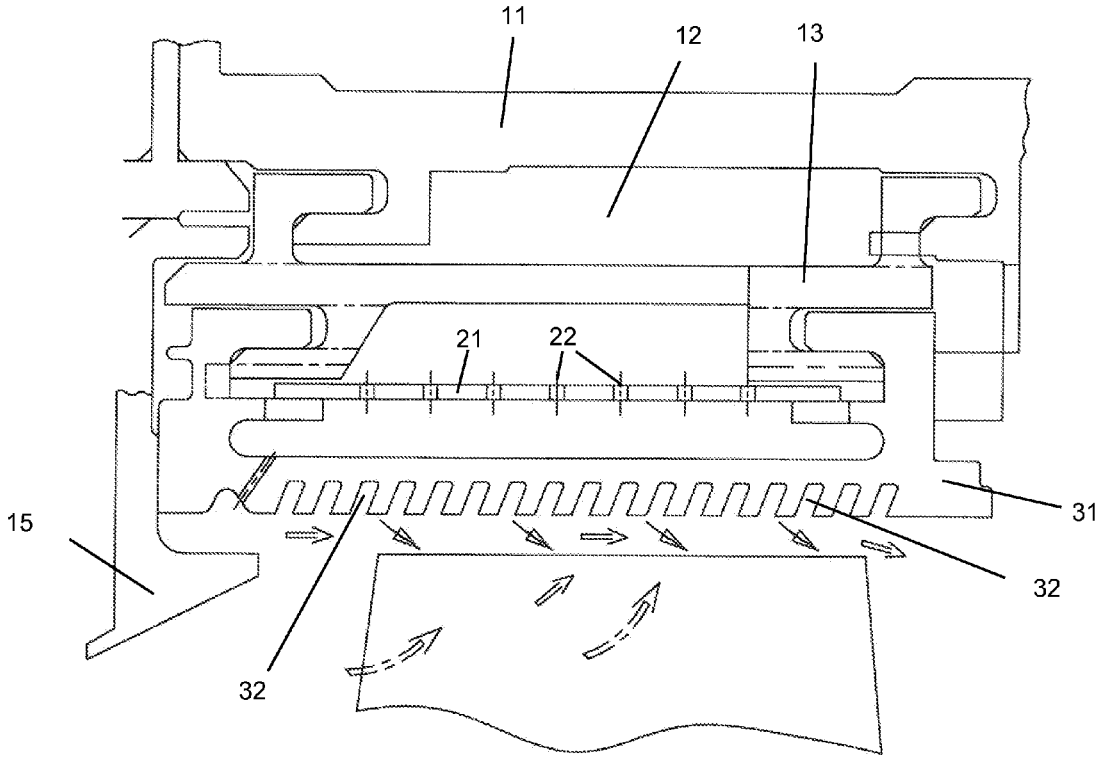
Fig 1 prior art
FIG. 1 shows a cross section view of a prior art turbine blade tip shroud design with grooves formed by teeth.
Figure 2:
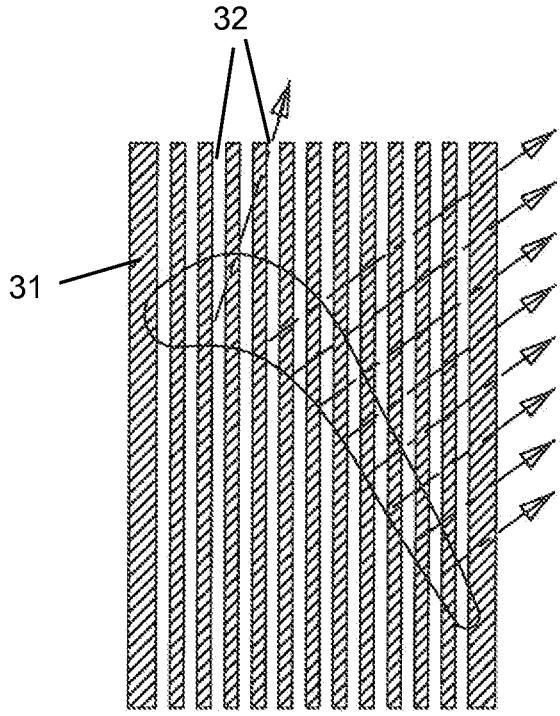
Fig 2 prior art
FIG. 2 shows a bottom view of the grooved blade tip shroud of FIG. 1.
Figure 3:
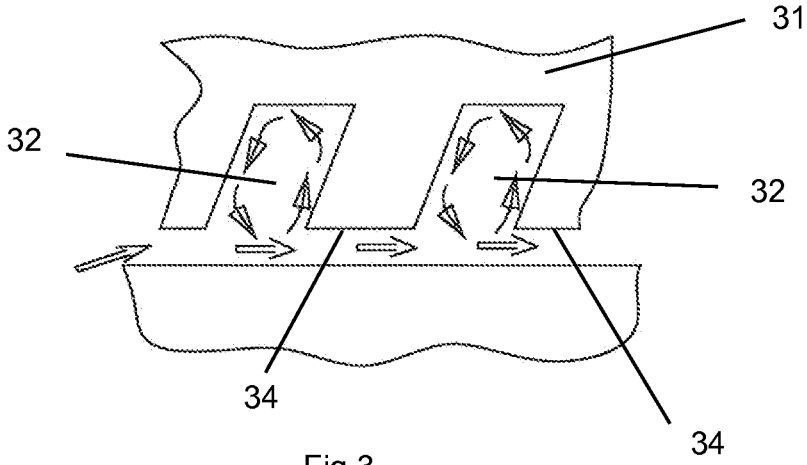
Fig 3 prior art
FIG. 3 shows a detailed view of a section of the blade tip shroud of FIG. 1 with a leakage flow recirculation and gap leakage flow paths.
Figure 4:
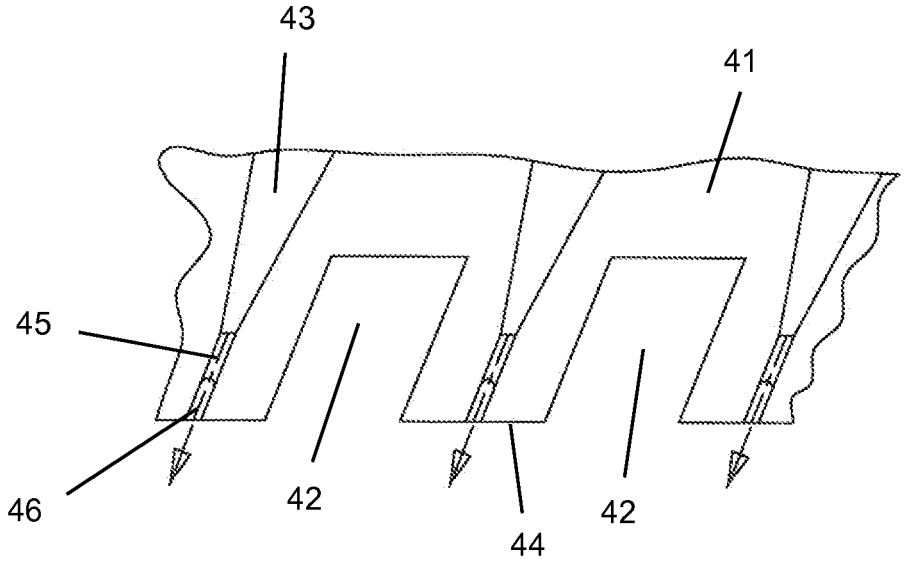
FIG. 4 shows a cross section view of a section of the blade tip shroud with teeth of grooves of the present invention with cooling passages in the teeth.

The turbine blade tip shroud of the present invention is the same as in the prior art but with the addition of cooling air passages formed within the teeth that open onto the inner surfaces of the teeth to discharge cooling air. FIG. 4 shows a section of the blade tip shroud 41 with three teeth 44 extending inward toward the blade tip and forming the grooves 42. Each of the teeth 44 include a series of cooling air passages formed with a inlet section having a convergent channel 43 that opens into a constant cross-section flow metering section 45, that then opens into a continuous slot exit groove 46 that opens onto the inner end of the tooth 44.

Figure 5:
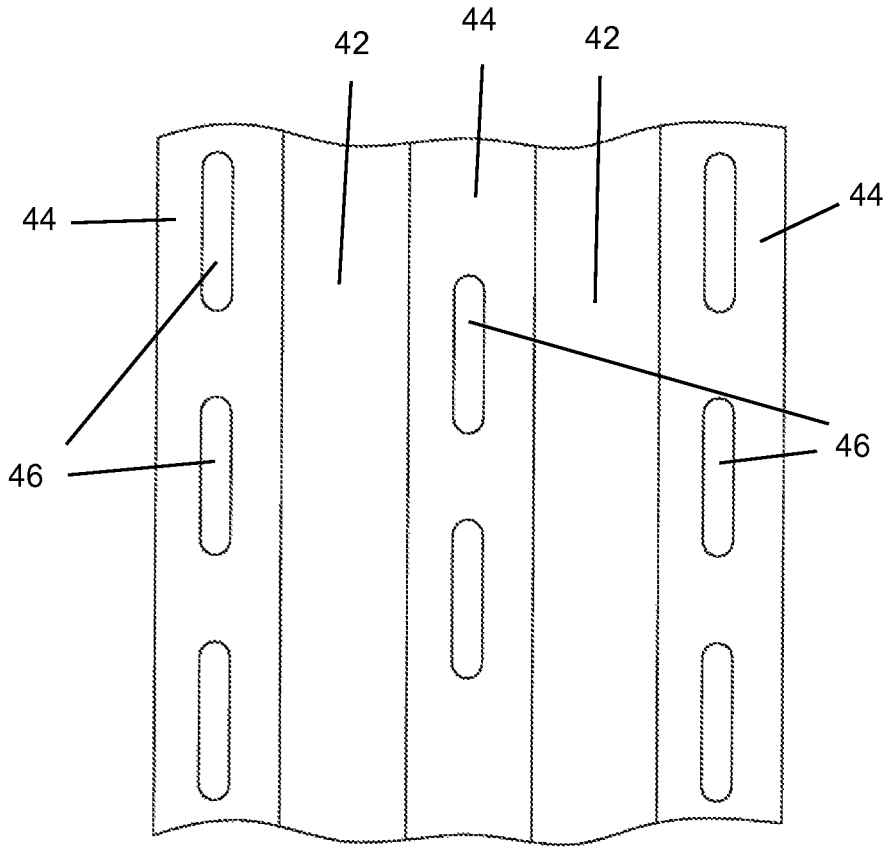
FIG. 5 shows a bottom side view of the section in FIG. 4 with the exit grooves opening in the teeth surfaces.

FIG. 5 shows a view from the bottom side of the blade tip shroud 41 with the grooves 42 formed by adjacent teeth 44, and with the continuous slot exit grooves 46 opening onto the teeth surface. As seen in FIG. 5, the teeth 44 and the grooves 42 are parallel and extend along a circumferential length of the blade tip shroud which is the direction of rotation of the blade. An axial width of the slots 46 is much less than the circumferential length of the slots 46. In one embodiment, a number of discrete slots 46 are formed along each of the teeth 44. Each discrete slot 46 is then connected to a separate convergent channel 43 and flow metering hole 45. In the embodiment with a number of discrete slots opening onto each of the teeth, the slots are staggered as seen in FIG. 5 in which a slot in a first row is aligned with a space between slots in a second row of teeth. In another embodiment, each of the teeth 44 has one long slot 46 that extends along substantially the entire circumferential length of the blade tip shroud, with each continuous long slot 46 connected to a number of convergent channels 43 with each convergent channel 43 connected to a flow metering section 45.

Figure 6:
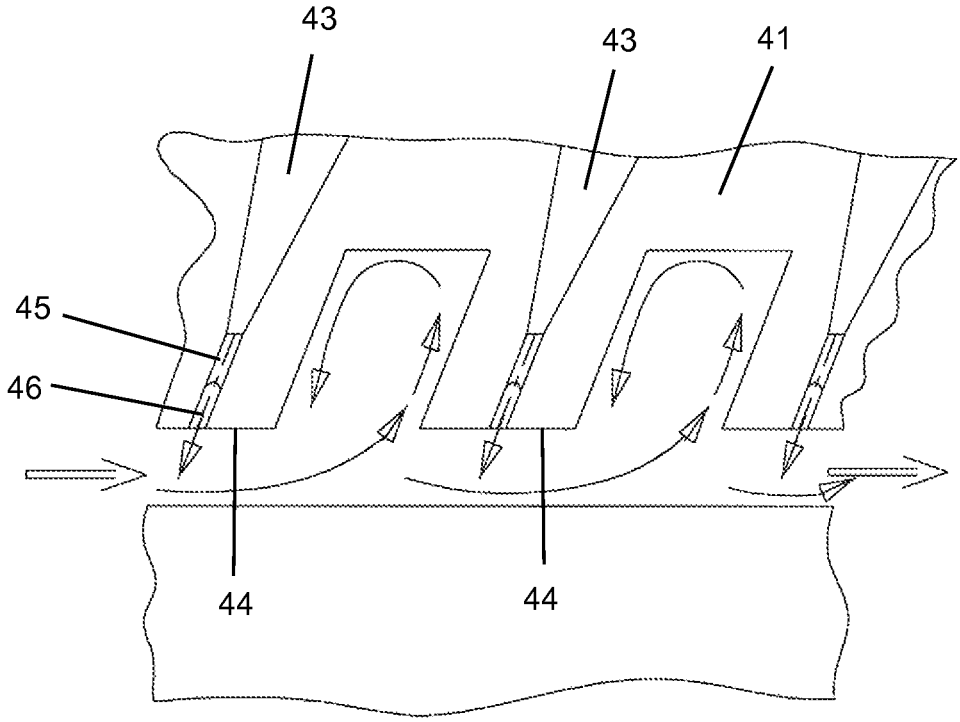
FIG. 6 shows a cross section view of a section of the blade tip shroud of the present invention with the leakage flow and the cooling air jet interaction flow paths.

FIG. 6 shows the section of the blade tips shroud 41 with resulting leakage flow path being restricted due to the injection of the cooling air from the passages formed within the teeth. A small effective leakage flow area is formed between the blade tip and the surface of each of the teeth 41. The cooling air passages in the teeth form a convergent flow channel with circumferential jet slot and exit groove arrangement for the blade tip shroud cooling and sealing process. The convergent metering exit slot with a continuous circumferential groove cooling geometry for the sealing teeth is used in the blade outer air seal.

In operation, due to a pressure gradient across the airfoil from the pressure side of the blade to a downstream section of the blade suction side, a secondary flow near to the pressure side surface leaks from the pressure side to the suction side as well as from the lower blade span and upward across the blade tip. Cooling air flowing through the convergent channel 43 accelerates the cooling air through the flow metering section 45 and the continuous slot 46 to inject a jet of cooling air into the gap formed between the blade tip and the teeth. The cooling air provides cooling for the blade tip shroud as well as reduce the affective hot gas flow leakage area (e.g., reduces the vena contractor) to form an air curtain against the hot gas flow. The cooling air jets reduce the leakage flow by pushing the leakage flow more toward the blade tips. In addition to the counter flow action, the slanted jet cooling stream forces the secondary flow to bend outward as the leakage flow enters the seal teeth and yields a smaller vena contractor than the prior art which therefore will reduce the effective leakage floe area.

The formation of the leakage flow resistance of the present invention for the blade outer air seal cooling channel geometry and cooling flow injection yields a very high resistance for the leakage flow path and therefore reduces the blade leakage flow. As a result, the blade outer air seal is cooled by a combination of film cooling and convection cooling. The blade tip gap is sealed with the air curtain thus formed by the ejection of the spent cooling air as air jets. This double usage of the cooling air in the blade tip shroud improves the cooling for the BOAS seal teeth and thus increases the useful life of the BOAS.

I claim the following:

1. A blade outer air seal for a turbine of an industrial gas turbine engine, the blade outer air seal comprising:

a blade tip shroud segment having an underside surface exposed to a hot gas stream passing through the turbine;

the underside surface having rows of grooves formed by rows of teeth;

the rows of teeth each having a convergent channel opening on a top of the blade tip shroud segment;

the convergent channels connected to constant cross-section flow metering holes; and, the constant cross-section flow metering holes connected to continuous slot exit grooves that open onto bottom surfaces of the rows of teeth.

2. The blade outer air seal of claim 1, and further comprising:

the rows of teeth and grooves formed by the rows of teeth cover substantially an entire bottom surface of the blade tip shroud segment.

3. The blade outer air seal of claim 1, and further comprising:

the rows of teeth and grooves formed by rows of teeth are parallel and extend along a circumferential direction of the turbine.

4. The blade outer air seal of claim 1, and further comprising:

the continuous slot exit grooves have a circumferential length much greater than an axial width.

5. The blade outer air seal of claim 1, and further comprising:

each of the rows of teeth have a plurality of discrete slots opening onto the bottom surfaces of the rows of teeth; and, each of the discrete slots is connected to a convergent channel and a flow metering section.

6. The blade outer air seal of claim 1, and further comprising:

each of the rows of teeth includes a single long slot that opens onto the bottom surface of each tooth; and, each of the single long slots is connected to a plurality of convergent channels with each convergent channel connected to a flow metering section.

* * * * *